United States Patent [19]

Michel

[11] Patent Number: 4,909,415

[45] Date of Patent: Mar. 20, 1990

[54] DEVICE FOR DISPENSING PAPER, PARTICULARLY TOILET PAPER

[76] Inventor: Yvan B. Michel, Les Sequoias, 83720 Trans-En-Provence, France

[21] Appl. No.: 167,363

[22] Filed: Mar. 14, 1988

[30] Foreign Application Priority Data

Mar. 13, 1987 [FR] France ..... 87 03476

[51] Int. Cl.[4] ..... B65H 1/00; A47K 10/42

[52] U.S. Cl. ..... 221/51; 221/52

[58] Field of Search ..... 221/51, 52, 56, 63; 211/51, 53; 312/61, 71

[56] References Cited

U.S. PATENT DOCUMENTS

| | | | |
|---|---|---|---|
| 813,594 | 2/1906 | Sexton | 221/52 |
| 1,354,511 | 10/1920 | Parsons . | |
| 1,464,180 | 8/1923 | Hudson | 221/63 |
| 1,497,562 | 6/1924 | Hellstrom | 221/52 |
| 1,511,812 | 10/1924 | Horwitt | 221/63 X |
| 1,583,293 | 5/1926 | Horwitt | 221/63 X |
| 1,610,670 | 12/1926 | Funk . | |
| 3,473,672 | 10/1969 | Fincher . | |

FOREIGN PATENT DOCUMENTS 503450 10/1947 United Kingdom .

*Primary Examiner*—Joseph J. Rolla
*Attorney, Agent, or Firm*—Steinberg & Raskin

[57] ABSTRACT

The present invention concerns a device for dispensing paper gathered in a paper block cut into pre-folded paper sheets, removably placed inside a casing with a substantially horizontal bottom, the casing containing at least one object of a predetermined minimal weight freely resting on the top of the paper block and providing an elongated, at least approximately median space forming a guiding slot for each paper sheet, the extraction of one sheet automatically provoking the insertion of the following paper sheet into the guiding slot.

1 Claim, 1 Drawing Sheet

4
7
11
14
10
8
12
9
12
1
13
3
6
2
5

7
14
10
8
4
II
9
II
6
15

DEVICE FOR DISPENSING PAPER, PARTICULARLY TOILET PAPER

BACKGROUND OF THE INVENTION

The present invention concerns generally a device for dispensing paper. It essentially has as an object a device for dispensing paper gathered in a block of paper cut into pre-folded paper sheets, which block is removably put inside a casing with a substantially horizontal bottom.

The invention can be applied to the dispensing of paper such as in particular as toilet paper, pocket handkerchief, cleansing tissue, note-paper or the like.

Paper dispensing devices for this type of paper block cut into pre-folded sheets are known.

A first toilet paper dispensing device comprises an aperture on the bottom of the casing containing the paper block. This aperture permits the one by one extraction of the paper sheets, but, when the paper block is complete, the extraction is often difficult at the beginning, due to stuffing effects of the paper sheets in the aperture. Besides, when the paper block is nearly spent, the remaining sheets pass together through the aperture during the extraction, and scatter on the ground.

A second toilet paper dispensing device comprises an aperture on a vertical face of the casing containing the paper block. The pre-folded paper sheets are extracted through this aperture. However, when the block is half used, the half-block remaining in the casing tends to wind inside this casing, the extraction thus becoming difficult. Furthermore, when the block is nearly spent, it collapses on the bottom of the casing and it is then no more possible to extract the remaining paper sheets through the aperture.

SUMMARY OF THE INVENTION

The present invention has as an object to solve the aforesaid problems, by proposing a device for dispensing paper, in particular toilet paper, with such a design that it permits an easy and effective one by one extraction of the pre-folded paper sheets, up to the last sheets of the paper block.

The solution according to the present invention consists of a device for dispensing paper, in particular toilet paper, gathered in a paper block cut into pre-folded paper sheets, removably placed inside a casing with a substantially horizontal bottom, characterized in that the casing contains at least one object of a predetermined minimal weight freely resting on the top of the paper block and providing an elongated, at least approximately median space forming a guiding slot for each sheet, the extraction of one sheet automatically provoking the insertion of the following paper sheet into the said guiding slot.

Thus, owing to this device, this kind of paper block is entirely used in a proper manner.

According to another feature of the invention, the aforesaid casing contains an object in the shape of a single plate provided with a sheet guiding slot.

According to another feature of the invention, the aforesaid casing contains two separate objects in the shape of transversally spaced plates.

According to still another feature of the invention, the aforesaid casing contains two separate objects in the shape of transversally spaced cylindrical bodies.

BRIEF DESCRIPTION OF THE DRAWINGS

The invention will be better understood, and further objects, features and details thereof will appear more clearly as the following explanatory description proceeds, with reference to the accompanying diagrammatic drawings given by way of non-limiting example only illustrating a presently preferred embodiment of the invention, and wherein.

DESCRIPTION OF THE PREFERRED EMBODIMENTS

Figure 2:
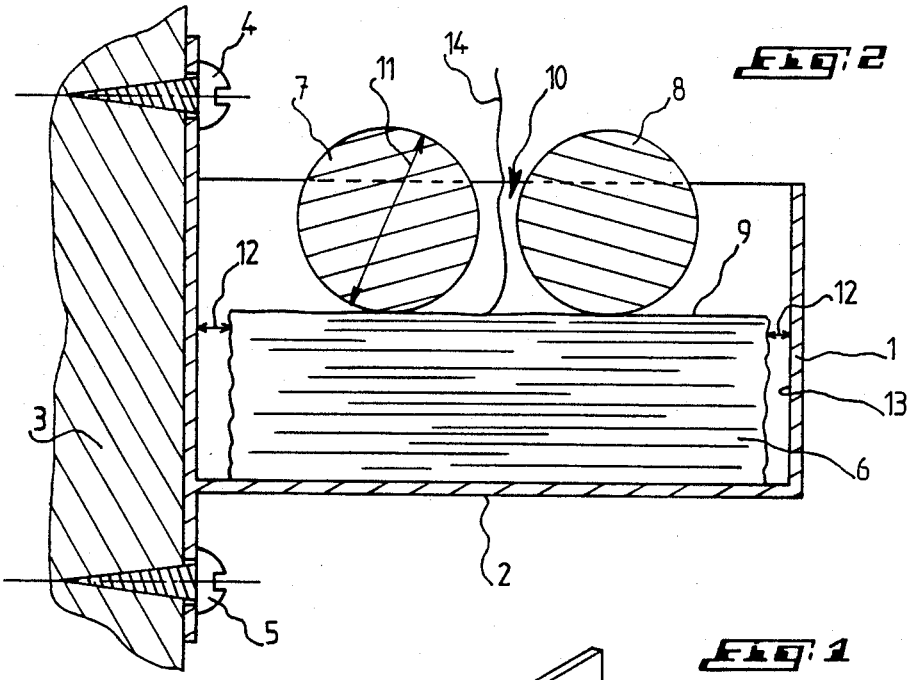
FIG. 2 is a cross-sectional view along line II—II of FIG. 1 of the dispensing device of the invention.
Figure 1:
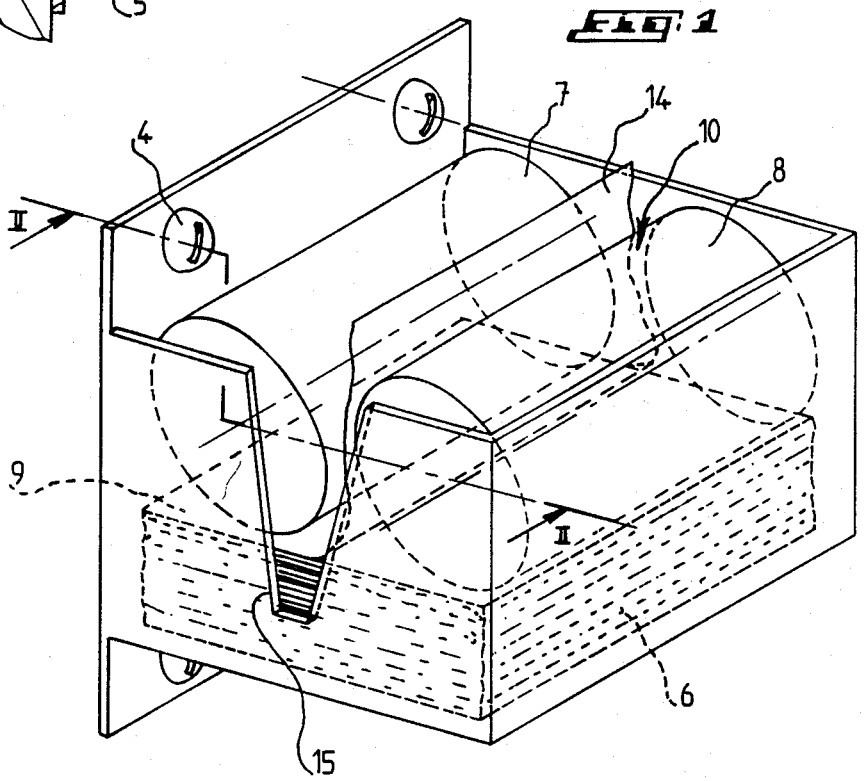
FIG. 1 is a perspective view according to an embodiment of the paper dispensing device of the invention.

Referring to FIGS. 1 and 2, the device for dispensing paper, in particular toilet paper, comprises a casing 1 for example parallelepipedic in shape, with a substantially horizontal bottom 2 and containing a paper block 6 cut into pre-folded paper sheets, which block being removably put inside this casing. The casing can be fixed on a support 3 formed for example of a wall by means of fixing devices such in particular as screws 4 and 5.

According to the invention, the casing is open at its upper face and contains two separate objects of a predetermined minimal weight in the shape of cylindrical bodies 7 and 8.

These cylindrical bodies are rolls which freely rest on the top 9 of the paper block 6. These rolls are transversally separated by an elongated space 10 forming a guiding slot for each paper sheet to be extracted. The predetermined minimal weight of these rolls is reckoned so as to be sufficient to maintain the rolls in the casing in contact with the paper block during the processes of extraction of the paper sheets, and depending on the density of the material used for manufacturing the rolls. Moreover, the diameter 11 of the rolls is at least twice as large as the width of each side space 12 existing between the paper block 6 and the corresponding side face 13 of the casing, which is parallel to the longitudinal axis of the rolls.

The diameter of the rolls is preferably such that the rolls cover almost entirely the surface 9 of the paper block; the two rolls serve then a purpose equivalent to that of a conventional casing cover where the elongated space between both rolls would form the extracting slot of the cover.

Finally, the casing is provided with an approximately vertical median aperture 15 on at least one of its side faces.

In order to put the device into the operating position, one just has to insert the first sheet 14 of the paper block 6 previously put in the casing 1, into the elongated space or guiding slot 10 between both rolls resting on the block. The aperture 15 on one of the side faces of the casing renders this insertion easier. As this first sheet is extracted upwards, the second sheet of the paper block is automatically inserted into the guiding slot 10. The weight of rolls 7 and 8 is such that, during the course of each sheet extraction, the rolls are alternately slightly raised with respect to each other, which facilitates the insertion of the following sheet into the guiding slot 10. The process can be started again until the paper block is spent, all the sheets being extracted one by one in an effective manner at the upper part of the casing.

The paper dispensing device according to the invention therefore permits the integral use of paper blocks while preventing the remaining paper block from falling on the ground and the sheet necessary to the one by one extraction of the sheets from being lost as in the known devices.

Besides, it is to be noted that between the different processes of sheet extraction, the last sheet inserted into the guiding slot 10 rests on one of the rolls and remains readily available for the further extracting process. The dispensing device which has been described in the foregoing contains, as objects of a predetermined minimal weight, two cylindrical bodies freely resting on the paper block. This embodiment is presently the best embodiment of the invention.

However, the general principle of the invention is applicable whatever the shape of the object(s) may be, provided that the weight of this (these) object(s) is sufficient to maintain it (them) continually in contact with the paper block so that a pressure appears on both sides of the elongated space forming a guiding slot for the successive paper sheets.

Thus, the object resting on the paper block may be in the shape of a single plate provided with an approximately median elongated space forming a guiding slot for each paper sheet. This plate may have a plane surface or a surface the profile of which presents a median part projecting outwardly from the casing, this part itself comprising the elongated space.

According to another embodiment, the objects which rest on the paper block are formed of two transversally spaced plates defining the elongated, at least approximately median space forming a guiding slot for the sheets. These two plates may be entirely free with respect to each other or may be bound. In the case where they are bound, the binding means are located on both sides of the elongated space and provide the plates with a certain mobility or lateral and vertical free motion, both plates being able to move in an independent manner with respect to each other.

According to an embodiment of the invention, the paper dispensing device may be equipped with a cover. This cover then comprises an aperture or slot for extracting the successive paper sheets, located at least approximately above the elongated space 10. The cover is useful for protecting the paper block and the object(s) of a predetermined weight which rest(s) on this paper block.

What is claimed is:

1. In a device for dispensing paper (6), in particular toilet paper (6), gathered in a block (6) of paper cut into pre-folded paper sheets (14), said block (6) being removably placed inside a casing (1) having a substantially horizontal bottom (2), said casing (1) containing two separate objects in the shape of cylindrical bodies (7, 8) such as rolls, which lay on an upper surface (9) of said paper block (6) and which define therebetween (7, 8), a space (10) allowing passage of a sheet of paper (14) to be extracted, said improvement comprising said two rolls (7, 8) are separated from one another and each has a large diameter (11), such that each roll (7, 8) is in contact on a zone of said upper surface (9) of said block (6) of paper located at about a middle of a half of said block (6) of paper in a direction perpendicular to an axis of said roll (7, 8), said passage space (10) is in the shape of a slot of relatively small width such that one (7) of said rolls (7, 8) constitutes a support surface for a sheet (14) engaged by a rear end portion thereof in the block (6) and passing through said slot (10), and said width of said slot (10) varying during the extraction of a sheet (14) while said rolls (7, 8) are alternately slightly raised with respect to one another (7, 8).

* * * * *